US006402493B1

(12) United States Patent
Matsubara et al.

(10) Patent No.: US 6,402,493 B1
(45) **Date of Patent: *Jun. 11, 2002**

(54) POWDER COMPACTING APPARATUS

(75) Inventors: Sadao Matsubara; Noboru Sugiura, both of Kumamoto (JP)

(73) Assignee: Honda Giken Kogyo Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/141,303

(22) Filed: Aug. 27, 1998

(30) Foreign Application Priority Data

Aug. 27, 1997 (JP) ..... 9-230169

(51) Int. Cl.[7] ..... B22F 3/03

(52) U.S. Cl. ..... 425/78; 264/109; 425/352; 425/415

(58) Field of Search ..... 425/78, 352, 356, 425/415; 264/109, 123

(56) References Cited

U.S. PATENT DOCUMENTS 3,191,232 A * 6/1965 Haller ..... 425/78
3,664,785 A * 5/1972 Marshall et al. ..... 425/78
3,694,127 A * 9/1972 Takahashi et al. ..... 425/352
3,761,212 A * 9/1973 Kontz ..... 425/154
4,379,684 A * 4/1983 Katagiri et al. ..... 425/78
5,043,123 A * 8/1991 Gormanns et al. ..... 264/114
5,364,253 A * 11/1994 Kojima et al. ..... 425/78
5,366,363 A * 11/1994 Good et al. ..... 425/78
5,378,416 A * 1/1995 Kishi et al. ..... 264/40.5
5,551,856 A * 9/1996 Katagiri ..... 425/78
5,694,640 A * 12/1997 Greetham ..... 419/38
5,812,924 A * 9/1998 Shaffer et al. ..... 419/2
5,874,114 A * 2/1999 Schrofele ..... 425/78

FOREIGN PATENT DOCUMENTS

DE 1 959647 7/1970
JP 5 016744 6/1975

* cited by examiner

*Primary Examiner*—Nam Nguyen
*Assistant Examiner*—Emmanuel S. Luk
(74) *Attorney, Agent, or Firm*—Birch, Stewart, Kolasch & Birch, LLP

(57) ABSTRACT

External helical teeth of an outer punch member of a lower punch are held in mesh with internal helical teeth of a floating die which is rotatable and floatingly supported. An upper punch is lowered toward a metal powdery material filled in a die cavity space defined by the inner circumferential surface of the floating die and the upper surface of the lower punch. The metal powdery material is compacted into a helical gear blank by the upper and lower punches while external helical teeth of an outer punch member of the upper punch are meshing with the internal helical teeth of the floating die. A presser rod extends downwardly from an upper plate which supports the upper punch forcibly lowers the floating die with respect to the lower punch in a latter period of the powder compacting process.

9 Claims, 6 Drawing Sheets

POWDER COMPACTING APPARATUS

BACKGROUND OF THE INVENTION

1. Field of the Invention

The present invention relates to an apparatus for compacting a metal powder into a gear blank such as a helical gear blank.

2. Description of the Related Art

It has been customary to manufacture gears for use in automobiles as sintered gears. FIG. 1 of the accompanying drawings shows one known powder compacting apparatus 51 for producing a compacted helical gear blank for use in automobiles.

As shown in FIG. 1, the powder compacting apparatus 51 comprises a horizontal lower plate 53 fixedly mounted on a foundation base 52, a horizontal floating plate 55 vertically slidably mounted on an intermediate portion of a vertical guide post 54 mounted on the foundation base 52 and floatingly supported by a floating mechanism (not shown), and an upper plate 56 vertically slidably engaging an upper end of the vertical guide post 54. A vertical lower punch 57 is mounted on the foundation base 52 and the lower plate 53. A floating die 58 is rotatably mounted on the floating plate 55. A vertical upper punch 59 is mounted on a horizontal punch holder plate 56*a* which is integrally mounted on the upper plate 56.

The lower punch 57 has external helical teeth p on its outer circumference, and the floating die 58 has internal helical teeth s on its inner circumference. The internal helical teeth s are held in mesh with the external helical teeth p.

The upper punch 59 comprises a vertical inner punch member 59*b* fixed to the punch holder plate 56*a* and a vertical outer punch member 59*a* disposed around the inner punch member 59*b* for rotation about its own axis. The outer punch member 59*a* has external helical teeth q on its outer circumference which can be held in mesh with the internal helical teeth s of the floating die 58.

The powder compacting apparatus 51 operates as follows: Initially, the upper punch 59 is in an elevated position. After a powdery material is filled in a die cavity space defined by the inner circumferential surface of the floating die 58 and the upper surface of the lower punch 57, the upper punch 59 is lowered to bring the external helical teeth q of the outer punch member 59*a* into mesh with the internal helical teeth s of the floating die 55. Upon continued downward movement of the upper punch 59, the upper punch 59 and the lower punch 57 compact the powdery material into a compacted helical gear blank W. As the upper punch 59 descends, the outer punch member 59*a* and the floating die 58 rotate about their axes to keep their helical teeth q, s out of interference with each other.

However, the powder compacting apparatus 51 suffers a disadvantage as described below. As shown in FIG. 2 of the accompanying drawings, the compacted helical gear blank W has different densities in the vertical direction. Specifically, the compacted helical gear blank W has a lower portion whose density is smaller than the density of an upper portion thereof.

SUMMARY OF THE INVENTION

It is therefore an object of the present invention to provide a powder compacting apparatus for producing a compacted helical gear blank which is free from density differences in the direction in which a powdery material is compacted into the compacted helical gear blank.

According to the present invention, there is provided a powder compacting apparatus comprising an upper punch having external helical teeth, a lower punch having external helical teeth, and a floating die is supported around the lower punch and having internal helical teeth meshing with the external helical teeth of the lower punch. The floating die and at least one of the upper and lower punches are rotatable about their own axes, the floating die and the lower punch jointly defining a die cavity space for being filled with a powdery material therein. The upper and lower punches are movable relatively toward each other to compact the powdery material in the die cavity space into a helical gear blank during a powder compacting process while the external helical teeth of the upper punch are meshing with the internal helical teeth of the floating die. The powder compacting apparatus has a floating die lowering mechanism for forcibly lowering the floating die a predetermined stroke with respect to the lower punch in a latter period of the powder compacting process.

If the floating die were not forcibly lowered, the helical gear blank being compacted would be caught by the internal helical teeth of the floating die. Therefore, upward reactive forces applied from the lower punch would not be sufficient, making the density of a lower portion of the helical gear blank smaller than the density of an upper portion of the helical gear blank. The floating die is forcibly lowered in order to increase the reactive forces from the lower punch.

When the floating die is forcibly lowered, even if the helical gear blank is caught by the internal helical teeth of the floating die, the helical gear blank is released from the internal helical teeth and has its lower surface reliably held against the upper surface of the lower punch. The lower punch can then apply sufficient upward reactive forces imposed on the helical gear blank which is being compacted between the upper punch and the lower punch.

The floating die lowering mechanism may comprise a presser rod for starting to lower the floating die when the upper punch is lowered a predetermined stroke.

The lower punch may be mounted on a lower plate, and the upper punch may be mounted on an upper plate, the upper plate being vertically movable toward the lower plate. A floating plate may be floatingly disposed between the upper plate and the lower plate, the floating die being mounted on the floating plate. The presser rod may be mounted on the upper plate and extend downwardly toward the floating plate.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

The principles of the present invention are particularly useful when embodied as a powder compacting apparatus for compacting a metal powdery material into a helical gear blank which is to be sintered into a helical gear.

Figure 1:
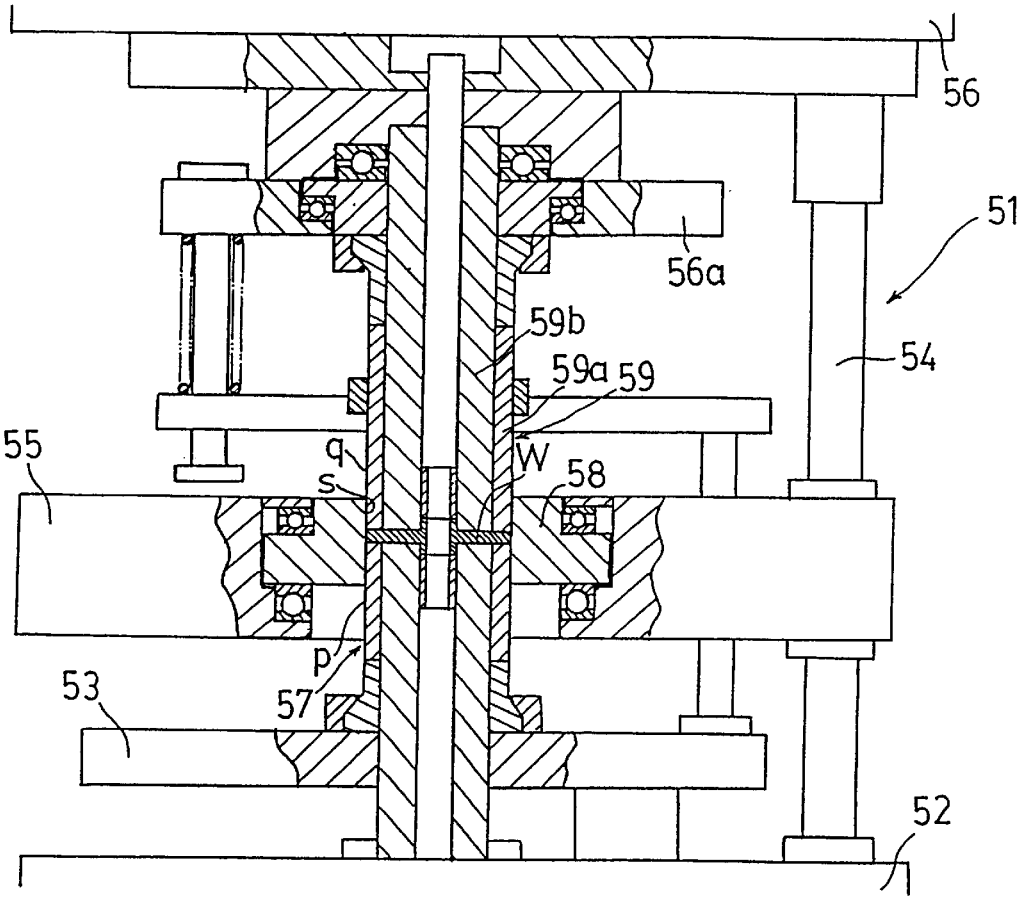
FIG. 1 BACKGROUND ART
FIG. 1 is a side elevational view, partly in cross section, of a conventional powder compacting apparatus.
Figure 2:
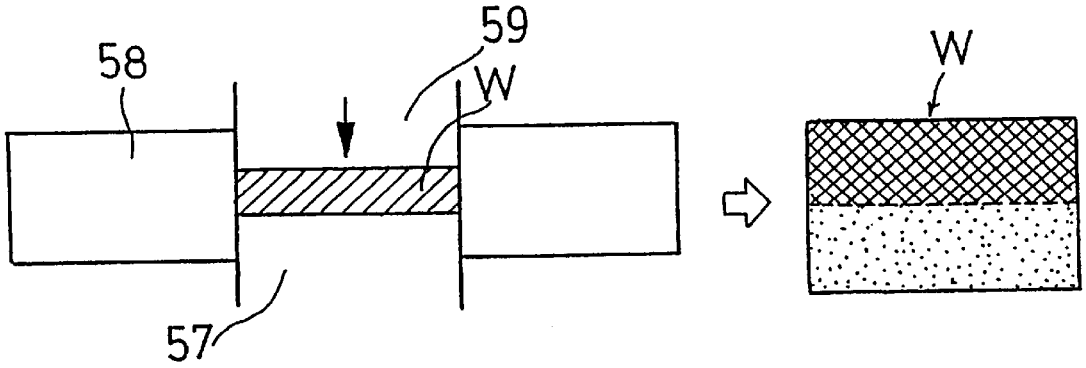
FIG. 2 BACKGROUND ART
FIG. 2 is a view illustrative of a density distribution in a compacted helical gear blank produced by the conventional powder compacting apparatus shown in FIG. 1.
Figure 3:
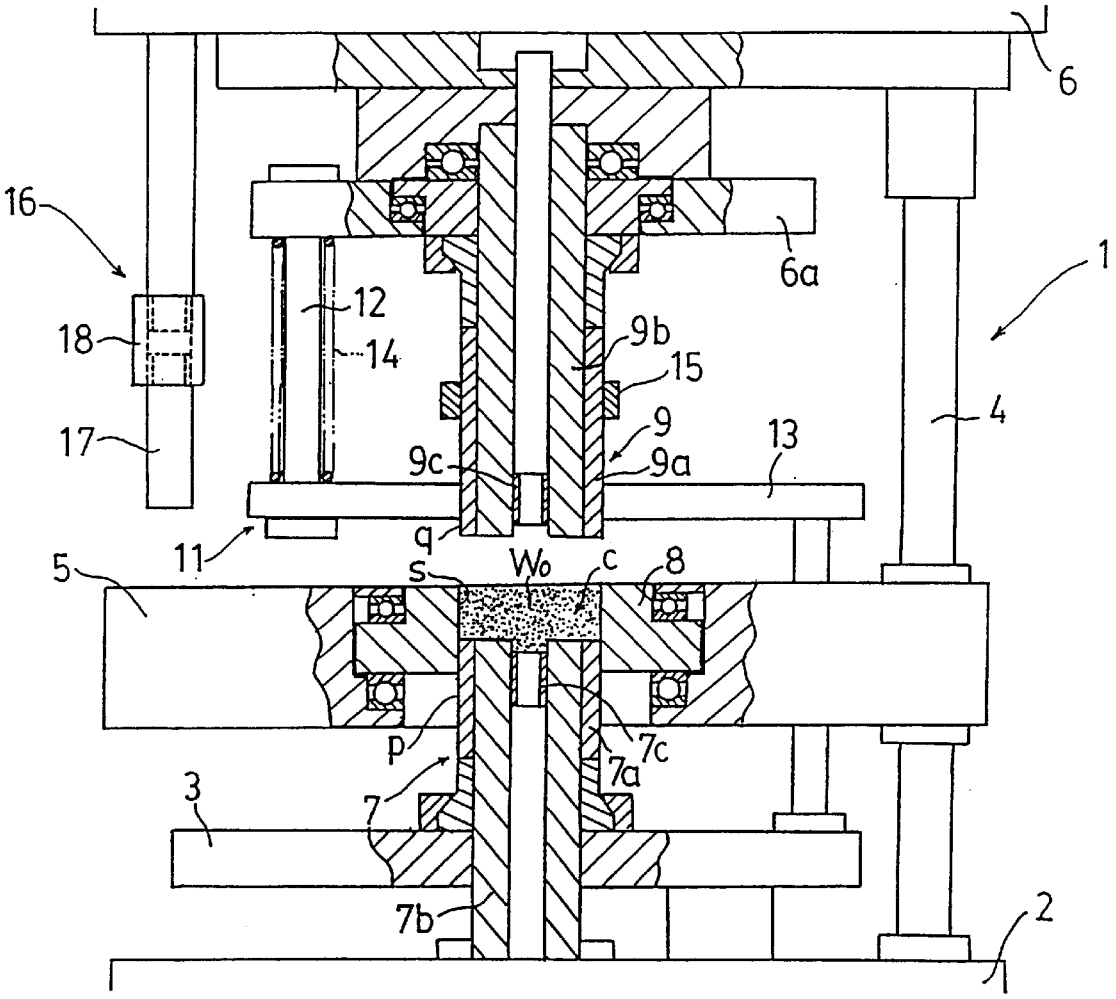
FIG. 3 is a side elevational view, partly in cross section, of a powder compacting apparatus according to the present invention, the view showing the position of the parts prior to compacting a powdery material.

As shown in FIG. 3, a powder compacting apparatus 1 according to the present invention comprises a horizontal lower plate 3 fixedly mounted on a foundation base 2, a vertical guide post 4 mounted on the foundation base 2, a horizontal floating plate 5 vertically slidably mounted on an intermediate portion of the vertical guide post 4, and a horizontal upper plate 6 vertically slidably engaging an upper end of the vertical guide post 4.

A vertical lower punch 7 is mounted on the foundation base 2 and the lower plate 3. A floating die 8 is rotatably mounted on the floating plate 5. A vertical upper punch 9 is mounted on a punch holder plate 6*a* which is integrally mounted on the upper plate 6.

The upper plate 6 can be pressed downwardly by a pressing mechanism (not shown). A recovery mechanism 11 is disposed between the punch holder plate 6*a* and the lower plate 3 for recovering the upper punch 9 to its original position when the pressure applied to the upper punch 9 by the pressing mechanism is removed.

The recovery mechanism 11 comprises a vertical guide rod 12 mounted on the punch holder plate 6*a* and a horizontal guide plate 13 slidably engaging the guide rod 12. A spring 14 is disposed around the guide rod 12 between the upper surface of the guide plate 13 and the lower surface of the punch holder plate 6*a*. The guide plate 13 is fixed to the lower plate 3.

When the upper plate 6 is pressed downwardly by the pressing mechanism, the upper punch 9 is lowered while compressing the spring 14. When the pressure applied to the upper plate 6 is removed, the upper punch 9 is moved back by the energy stored in the spring 14.

The floating plate 5 is floatingly supported by a floating mechanism (not shown). The floating mechanism comprises an air cylinder unit, for example, which is coupled to the floating plate 5. When a load in excess of a certain load level is imposed on the floating plate 5, the floating plate 5 moves upwardly or downwardly.

The lower punch 7 comprises a vertical tubular inner punch member 7*b* fixedly mounted on the foundation base 2, a boss punch member 7*c* disposed in the tubular inner punch member 7*b*, and a vertical tubular outer punch member 7*a* fixedly mounted on the lower plate 3 and disposed around the inner punch member 7*b*. The outer punch member 7*a* has external helical teeth p on its outer circumference.

The floating die 8 is rotatable about its own vertical axis with respect to the floating plate 5, and has internal helical teeth s on its inner circumference.

The internal helical teeth s are held in mesh with the external helical teeth p of the outer punch member 7*a* such that the upper surface of the floating die 8 lies higher than the upper surface of the lower punch 7, defining a die cavity space c with the inner circumferential surface of the floating die 8 and the upper surface of the lower punch 7.

The upper punch 9 comprises a vertical tubular inner punch member 9*b* fixed to the punch holder plate 6*a*, a boss punch member 9*c* disposed in the tubular inner punch member 9*b*, and a vertical outer punch member 9*a* disposed around the inner punch member 9*b* for rotation about its own axis with respect to the punch holder plate 6*a*. The outer punch member 9*a* has external helical teeth 9 on its outer circumference which can be held in mesh with the internal helical teeth s of the floating die 8.

A guide plate 15 is mounted on the outer circumferential surface of the outer punch member 9*a* for guiding the upper punch 9 in its vertical movement.

According to the present invention, the powder compacting apparatus 1 has a floating die lowering mechanism 16 for forcibly lowering the floating die 8 with respect to the lower punch 7 in a latter period of a powder compacting process carried out by the powder compacting apparatus 1. The floating die lowering mechanism 16 comprises a vertical presser rod 17 mounted on the upper plate 6.

Specifically, the vertical presser rod 17 extends downwardly from the lower surface of the upper plate 6, and has a lower end spaced a certain clearance upwardly from the upper surface of the floating plate 5 before the powder compacting process is carried out by the powder compacting apparatus 1. In the latter period of the powder compacting process during which the upper punch 9 descends, the vertical presser rod 17 engages and forcibly lowers the floating plate 5.

A turnbuckle 18 for adjusting the length of the vertical presser rod 17 is mounted on the vertical presser rod 17 in its intermediate region.

Operation of the powder compacting apparatus 1 will be described below.

As shown in FIG. 3, when the upper punch 9 is elevated, the die cavity space c is filled with a metal powdery material Wo.

Then, the upper plate 6 is lowered by the non-illustrated pressing mechanism. The outer punch member 9*a* and the floating die 8 are angularly positioned relatively to each other by an angular positioning mechanism (not shown) such that when the lower surface of the upper punch 9 lies flush with the upper surface of the floating die 8, the external helical teeth q smoothly start meshing with the internal helical teeth s.

When the external helical teeth q start meshing with the internal helical teeth s and the upper punch 9 further descends, the outer punch member 9*a* or the floating die 8 is rotated about its own axis to keep their helical teeth q, s out of interference with each other.

The metal powdery material Wo in the die cavity space c is compacted into a helical gear blank W by the upper punch 9 and the lower punch 7. In a latter period of the powder compacting process, the lower end of the presser rod 17 engages the upper surface of the floating plate 5, and forcibly lowers the floating die 8.

If the floating die 8 were not forcibly lowered, the helical gear blank W being compacted would be caught by the internal helical teeth s of the floating die 8. Therefore, upward reactive forces applied from the lower punch 7 would be small, making the density of a lower portion of the helical gear blank W smaller than the density of an upper portion of the helical gear blank W. The floating die 8 is forcibly lowered in order to increase the reactive forces from the lower punch 7.

Figure 4:
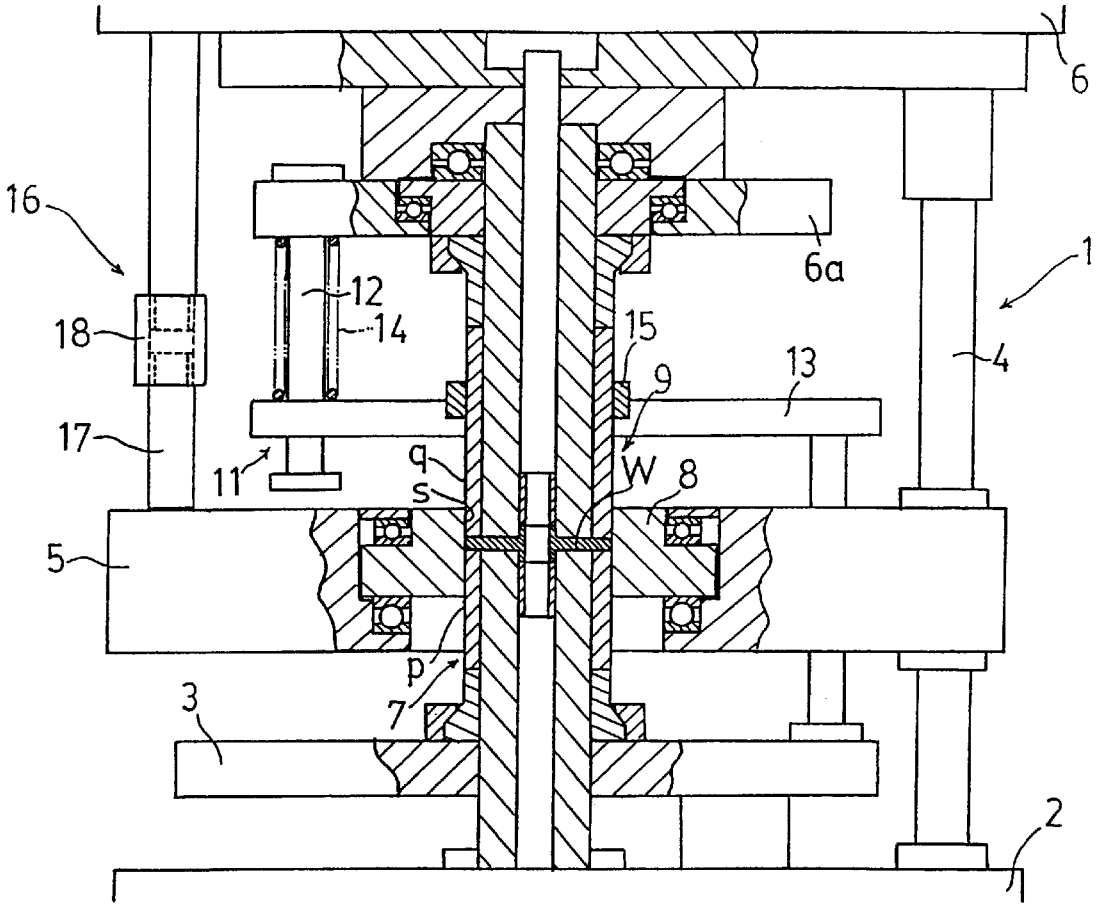
FIG. 4 is a side elevational view, partly in cross section, of the powder compacting apparatus shown in FIG. 3, the view showing the position of the parts at the time the powdery material is compacted into a compacted helical gear blank.

When the floating die 8 is forcibly lowered, even if the helical gear blank W is caught by the internal helical teeth s of the floating die 8, the helical gear blank W is released from the internal helical teeth s and has its lower surface reliably held against the upper surface of the lower punch 7. As shown in FIG. 4, the floating plate 5 is pressed downwardly by the presser rod 17 to lower the floating die 8 as the helical gear blank W is fully compacted between the upper punch 9 and the lower punch 7.

Figure 5:
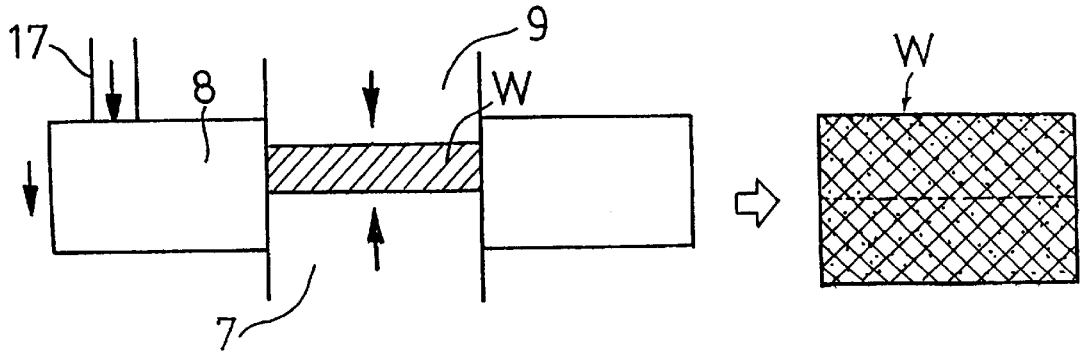
FIG. 5 is a view illustrative of a density distribution in the compacted helical gear blank produced by the powder compacting apparatus shown in FIGS. 3 and 4.

As shown in FIG. 5, the compacted helical gear blank W has a uniform vertical density distribution which is achieved by increased reactive forces applied from the lower punch 7.

Figure 6:
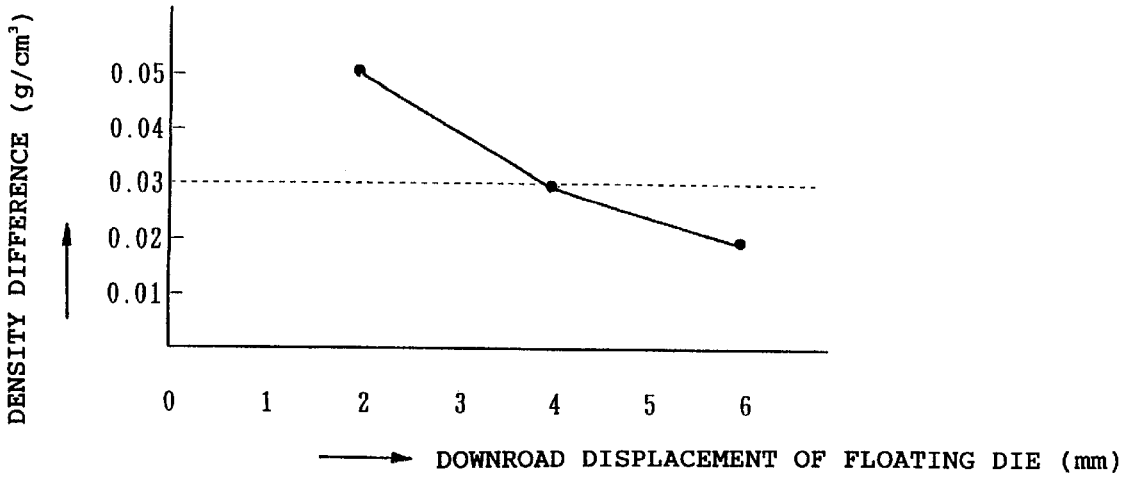
FIG. 6 is a graph of experimental data showing the relationship between the downward displacement of a floating die and the density difference in the compacted helical gear blank.

FIG. 6 illustrates the data of an experiment showing the relationship between the downward displacement of the floating die 8 and the density difference in the compacted helical gear blank W.

In the experiment, when the floating die 8 was not forcibly lowered by the presser rod 17, the floating die 8 was lowered a distance of 2 mm, and the density difference between upper and lower portions of a compacted helical gear blank W was 0.05 $g/cm_3$. When the floating die 8 was forcibly lowered a distance of 4 mm by the presser rod 17, the density difference between upper and lower portions of a compacted helical gear blank W was 0.03 $g/cm^3$ which fell in an acceptable range. When the floating die 8 was forcibly lowered a distance of 6 mm by the presser rod 17, the density difference between upper and lower portions of a compacted helical gear blank W was 0.02 $g/cm^3$.

Therefore, when the floating die 8 is forcibly lowered, the density difference between upper and lower portions of the compacted helical gear blank W is so reduced that the compacted helical gear blank W is made substantially homogeneous.

In the illustrated embodiment, the boss punches 7*c*, 9*c* serve to press the center of the helical gear blank W into a boss.

While the outer punch member 9*a* and the floating die 8 are rotatable about their own axes in the above embodiment, the outer punch member 7*a* and the floating die 8 may be made rotatable about their own axes, or all the outer punch member 9*a*, the outer punch member 7*a*, and the floating die 8 may be made rotatable about their own axes.

Furthermore, depending on the shape of a gear blank to be produced, the upper punch 9 or the lower punch 7 in its entirety may be made rotatable about its own axis.

The floating die lowering mechanism 16 may employ a hydraulic or pneumatic mechanism or a cam mechanism, instead of the presser rod 17, for forcibly lowering the floating plate 5 and hence the floating die 8.

The description of the present invention is directed to a first embodiment wherein the upper punch is moved and the lower punch is stationary. It is to be understood that the present invention includes the embodiments wherein the lower punch is moved and the upper punch is held stationary. In addition, the upper and lower punches can be moved relative to each other.

Although a certain preferred embodiment of the present invention has been shown and described in detail, it should be understood that various changes and modifications may be made therein without departing from the scope of the appended claims.

What is claimed is:

1. A powder compacting apparatus comprising:

an upper punch having external helical teeth, said upper punch being mounted on a first axis;

a lower punch having external helical teeth, said lower punch being mounted on a support, said lower punch being fixed and not rotatable;

a floating die floatingly supported around said lower punch and having internal helical teeth meshing with said external helical teeth of the lower punch, said floating die being mounted on a second axis;

said floating die and said upper punch being rotatable, respectively, about said first and second axes, said floating die and said lower punch jointly defining a die cavity space for filling with a powdery material therein;

a floating plate operatively positioned relative to said upper punch and said lower punch, said floating die being rotatably mounted relative to said floating plate, said floating plate being moveable up and down and being fixed against rotation relative to said lower punch;

means for moving said upper punch relative to said lower punch to compact the powdery material in said die cavity space into a helical gear blank during a powder compacting process while said external helical teeth of the upper punch are meshing with said internal helical teeth of the floating die; and a floating die lowering mechanism including a presser rod for engaging an upper surface of said floating plate for forcibly lowering said floating die a predetermined stroke with respect to said lower punch in a latter intermediate period of said powder compacting process, said floating die being lowered with said upper punch when the powdered material at an upper portion of said die cavity is initially compacted to enable said lower punch to initially compact the powdered material at a lower portion of said die cavity for compacting the powdery material with minor differences in the density of an upper and lower portion of the compacted material, whereby a reactive force from the lower punch is increased when the presser rod forcefully presses the floating die down through the floating plate.

2. The powder compacting apparatus according to claim 1, wherein said presser rod is operatively connected to said floating die for lowering said floating die upon actuation of said upper punch by a predetermined stroke.

3. The powder compacting apparatus according to claim 2, and further comprising:

a lower plate, said lower punch being mounted on said lower plate; and an upper plate, said upper punch being mounted on said upper plate, said upper plate being vertically movable toward said lower plate;

said presser rod being mounted on said upper plate and extending downwardly toward said floating plate.

4. The powder compacting apparatus according to claim 1, wherein said presser rod includes a first section and a second section and further including a turnbuckle operatively positioned between said first and second sections for adjusting a vertical length of said presser rod.

5. The powder compacting apparatus according to claim 1, wherein said upper punch includes an inner punch secured to a punch holder plate and an outer punch mounted around said inner punch, said outer punch being rotatably mounted relative to said punch holder plate.

6. The powder compacting apparatus according to claim 5, and further including a guide plate spaced relative to said punch holder plate for guiding the movement of said upper punch.

7. The powder compacting apparatus according to claim 6, and further including a recovery mechanism for biasing said punch holder plate relative to said guide plate.

8. The powder compacting apparatus according to claim 7, wherein said recovery mechanism is a spring for normally biasing said punch holder plate relative to said guide plate.

9. A powder compacting apparatus for the manufacture of a helical gear blank comprising:

an upper punch having external helical teeth;

a lower punch having external helical teeth, said lower punch being fixed and not rotatable;

a die having internal helical teeth meshingly engageable with said external helical teeth of the upper punch and the lower punch;

said die and said upper punch being rotatable about their axes;

said die and said punches jointly defining a die cavity space for being filled with a powdery material therein, and a driving device for moving said upper and said lower punch relatively toward each other to compact the powdery material in said die cavity space to form a helical gear blank; and a die lowering mechanism for forcibly lowering said die relative to said lower punch at a predetermined stroke when said upper punch has already been lowered into the die at a predetermined stroke for compacting the powdery material with minor differences in the density of an upper and lower portion of the compacted material, whereby a reactive force from the lower punch is increased when the presser rod forcefully presses the floating die down through the floating plate.

* * * * *